US008410892B2

(12) United States Patent
Sandberg

(10) Patent No.: US 8,410,892 B2
(45) Date of Patent: Apr. 2, 2013

(54) CONDUCTIVE MATRIX POWER CONTROL SYSTEM WITH BIASING TO CAUSE TRIPPING OF THE SYSTEM

(76) Inventor: Chester L. Sandberg, Palo Alto, CA (US)

( * ) Notice: Subject to any disclaimer, the term of this patent is extended or adjusted under 35 U.S.C. 154(b) by 22 days.

(21) Appl. No.: 13/211,907

(22) Filed: Aug. 17, 2011

(65) Prior Publication Data

US 2012/0044041 A1 Feb. 23, 2012

Related U.S. Application Data

(60) Provisional application No. 61/375,648, filed on Aug. 20, 2010.

(51) Int. Cl.
*H01C 7/10* (2006.01)

(52) U.S. Cl. ..... 338/22 R

(58) Field of Classification Search ..... 338/22 R
See application file for complete search history.

(56) References Cited

U.S. PATENT DOCUMENTS 5,140,297 A * 8/1992 Jacobs et al. ..... 338/22 R
5,896,264 A * 4/1999 Bijlenga et al. ..... 361/106
7,609,141 B2 * 10/2009 Harris et al. ..... 338/21
7,609,142 B2 * 10/2009 Koyama et al. ..... 338/22 R

* cited by examiner

*Primary Examiner* — Kyung Lee
(74) *Attorney, Agent, or Firm* — Edward J. Radio; Radio IP Law Group

(57) ABSTRACT

A three-terminal device (1, 21, 31) which can operate as an electrical switch, controlled by a third terminal (3, 24, 36/36A) that controls switching the device (1, 21, 31) from a closed circuit (conducting) state to an open circuit (insulating) state. Polymer and/or ceramic materials are loaded with different conductive materials, forming a device (1, 21, 31) having various electrical conductivities depending on local temperature. In preferred embodiments, the device (1, 21, 31) exhibits a non-linear increase or decrease in resistance versus temperature. Various embodiments of the three-terminal devices (1, 21, 31) are disclosed. The third terminal (3, 24, 36/36A) may be a non-electrically conductive biasing element such as a thermal transfer rod or tube containing a variable temperature fluid.

22 Claims, 3 Drawing Sheets

CONDUCTIVE MATRIX POWER CONTROL SYSTEM WITH BIASING TO CAUSE TRIPPING OF THE SYSTEM

RELATED PATENT APPLICATION

This patent application claims the benefit of commonly owned U.S. provisional patent application 61/375,648 filed Aug. 20, 2010 entitled "Power Control System with Biasing to Create Tripping of System", which provisional patent application is hereby incorporated by reference in its entirety into the present patent application.

TECHNICAL FIELD

This invention pertains to the field of breaking and restoring the electrical conductivity of an electrical circuit.

BACKGROUND ART

Two-terminal PTC (Positive Temperature Coefficient of resistance) and NTC (Negative Temperature Coefficient of resistance) variable resistance devices have been known and used since the 1970's.

Fuse and circuit breaker replacement PTC devices have been used in batteries, motor protectors, and telecommunications equipment for many years. The advantage of this technology over both fuses and circuit breakers is that such a device is self-resetting when the cause of the voltage or current overload is removed and the device cools down. For example, a child physically holds an electric window down in a car, while simultaneously pushing the "close" button for the window. Objectionably high current is produced in the motor circuit, which could burn out the motor. This increased current trips a PTC device which has been inserted in the electrical circuit that controls the window, limiting the current, and preventing burnout of the motor. The child releases the "close" button and stops physically restraining the window, the PTC device cools down, and normal operation of the electrical window is then restored. This technology can be used to prevent overheating of lithium ion batteries and destructive currents in computer circuits, and, as mentioned above, can protect motors that control electrical windows, electrical seats, electrical windshield wipers, and other devices in cars.

DISCLOSURE OF INVENTION

The present patent application describes various methods and apparati for biasing a two terminal device to initiate tripping and reset of the "switch" function of the device, making it in essence a three-terminal device (1, 21, 31). In this patent application, "tripping" means setting the device (1, 21, 31) to a non-conducting state, and "resetting" means returning the device (1, 21, 31) to a conducting state. Either a segment of the device (1, 21, 31) or the entire device (1, 21, 31) may be used as an intrinsic switch. In some embodiments, a "hotline" (4, 23, 34) is created within the device (1, 21, 31), and a significant portion of the voltage drop will occur across this hotline section (4, 23, 34). In other embodiments, the voltage drop is linear across the entire device (1, 21, 31). A number of embodiments of geometric, thermal, electrical, and physical biasing of the device (1, 21, 31) are disclosed herein, including electrical tripping, mechanical pressure tripping, geometrical section reduction or enhancement tripping, and fiber optic light and laser tripping. This list is not meant to be exhaustive; other options not mentioned, in combination with disclosed options, may be used.

BRIEF DESCRIPTION OF THE DRAWINGS

These and other more detailed and specific objects and features of the present invention are more fully disclosed in the following specification, reference being had to the accompanying drawings, in which.

DETAILED DESCRIPTION OF PREFERRED EMBODIMENTS

Figure 1:
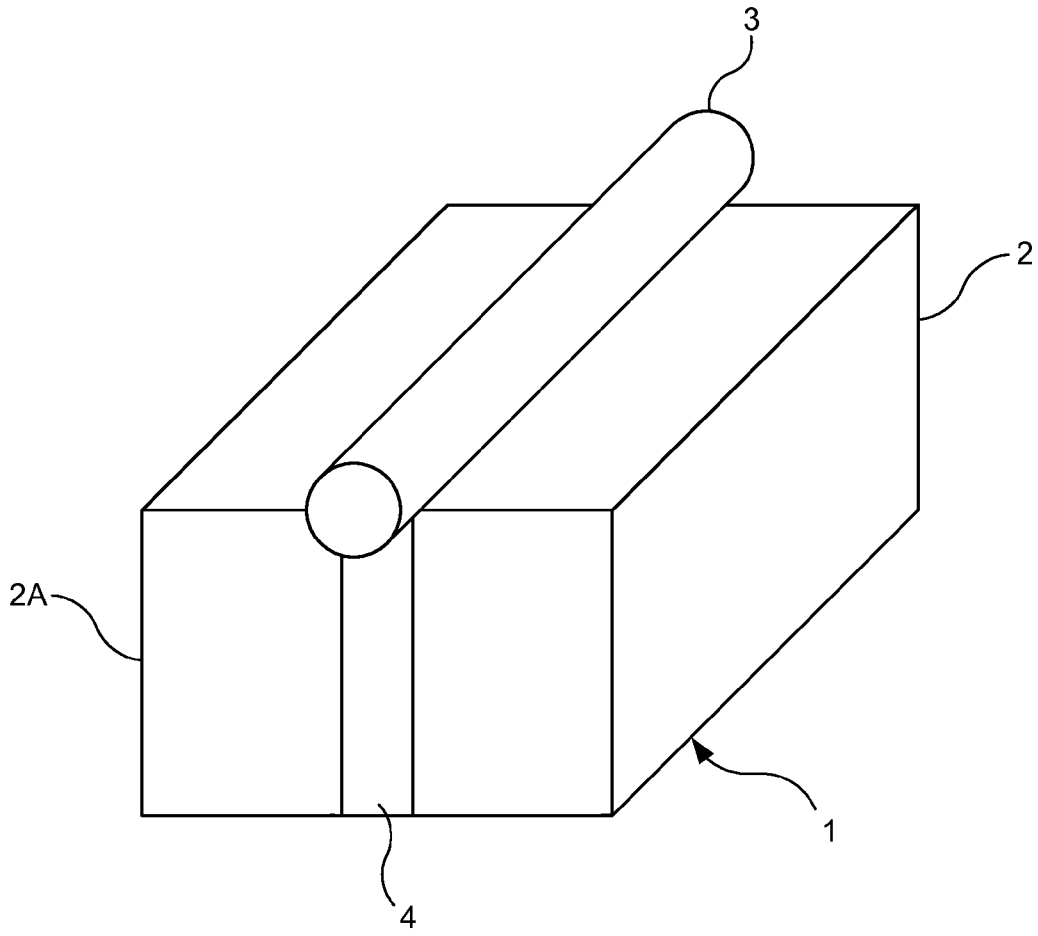
FIG. 1 is an isometric view of a first embodiment of the present invention wherein the third terminal 3 is a heated wire.

FIG. 1 shows an electrically conductive matrix 1 with first and second electrical terminals 2, 2A coupled to a load (not illustrated), and a third terminal 3 embedded in an upper surface of the matrix 1 and coupled to the two terminals 2, 2A. The primary current flows from terminal 2 to terminal 2A, or vice versa. A third terminal comprising a wire 3 is positioned such that heat flowing through wire 3 will heat a local section 4 of the conductive matrix 1. When the temperature is sufficiently high, as determined by the thermal and electrical characteristics of matrix 1, matrix 1 will trip. When matrix 1 cools off, it will reset.

Matrix 1 comprises electrically conductive material having specific resistance properties. The material can be PTC or NTC. For example, the material 1 can be a polymer and/or ceramic "loaded" to produce the desired properties. As used herein, "loaded" means incorporating conductive particles into the material 1 to change the electrical conductivity of the material 1 as a function of temperature. Possible loadings for the material 1 depend upon various geometric and conduction requirements, as documented elsewhere and as known to those skilled in the art, and therefore won't be described in detail in this specification. Loadings can also be metallic particles that may be heated inductively, by microwave or the equivalent.

In one embodiment, the material 1 is a ceramic PTC substance such as barium titinate.

In one embodiment, the material 1 is a polymeric structure, or a combination of a ceramic and a polymer.

Preferably but not necessarily, matrix 1 exhibits a non-linear increase or decrease in resistance as a function of temperature. The geometrical design of matrix 1 can be chosen to facilitate such a non-linear response.

The conductive material 1 can be overcoated with a thermal insulation layer to change the time constant of the thermal path during reset.

The third terminal 3 may be a fiber optic tube adapted to heat the matrix 1, or a void tube into which a laser beam is introduced, again to heat the matrix 1.

Terminals 2, 2A are preferably constructed of a highly electrically conductive material such as copper, aluminum, or another highly conductive material. The third terminal wire 3 can be either electrically insulated from the conductive matrix 1, or not insulated. Since the third terminal wire 3 displaces some of the material of the conductive matrix 1, there is a greater current concentration in area 4 than in other areas of the matrix 1. This current concentration automatically determines the location of a high resistance area (hotline) 4 where the majority of the voltage drop will occur when the device 1 is in the tripped condition. For instance, if terminal 2A is at zero volts and terminal 2 is at 10 volts, in the tripped state one face (the left face from the perspective of FIG. 1) of area 4 may be at 1 volt and the other face (the right face) at 9 volts. In the reset state, these two voltages may be 4.9 volts and 5.1 volts, respectively.

In alternative embodiments, trip control 3 can be a tube containing flowing fluid, a lossy fiber optic that heats, a heat pipe adapted to transfer thermal energy to matrix 1 from a remote system, or any other thermal or mechanical construction that can cause the trip function in the conductive matrix 1.

Figure 2:
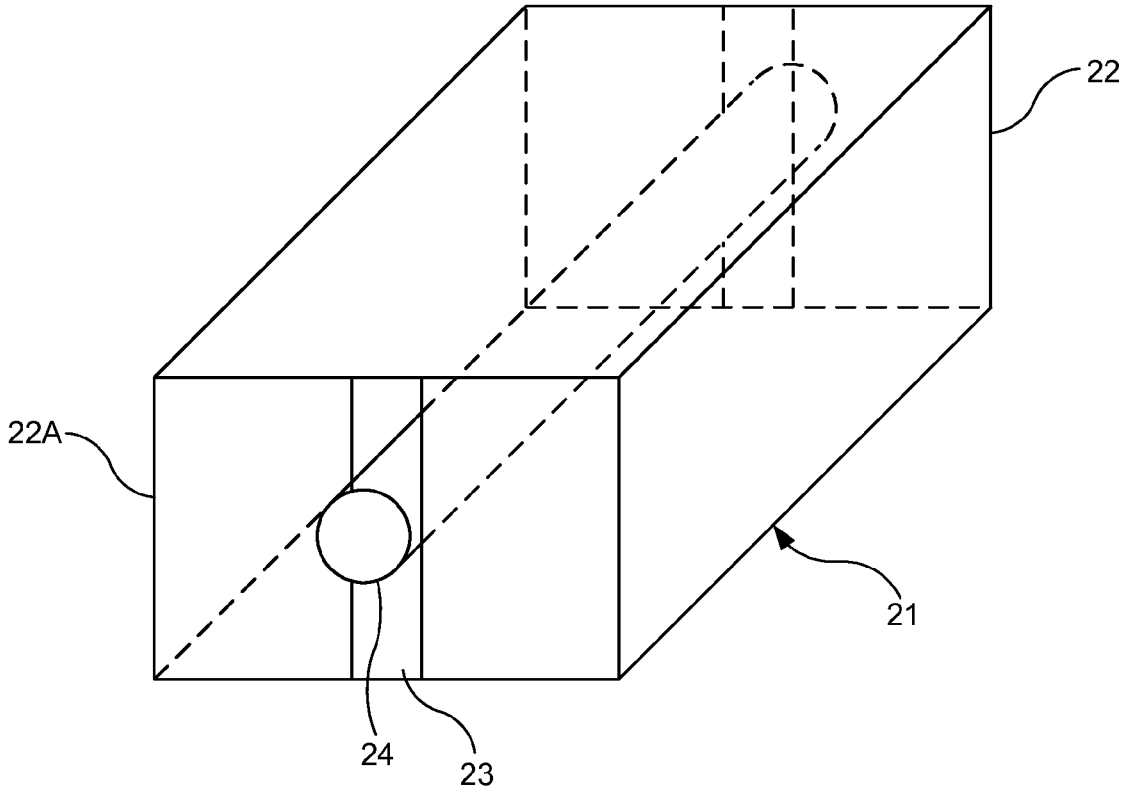
FIG. 2 is an isometric view of a second embodiment of the present invention in which the third terminal 24 is embedded in conductive matrix 21.

FIG. 2 shows an embodiment in which the third terminal trip element 24 is embedded within the conductive matrix 21. Again, the functionality of the items described in conjunction with FIG. 1 are available for use in the construction of the FIG. 2 embodiment. A preferred construction for trip element 24 is an embedded insulated or non-insulated electrical conductor 24 capable of heating itself, or providing current to heat electrically conductive terminals 22 and 22A. This technique will again form a hotline 23 which will produce dual voltage states as described above. As in the FIG. 1 embodiment, the physical displacement of the conductive material of matrix 21 provides an optimum location for the formation of a hotline 23 when the device 21 is in the tripped condition.

Figure 3:
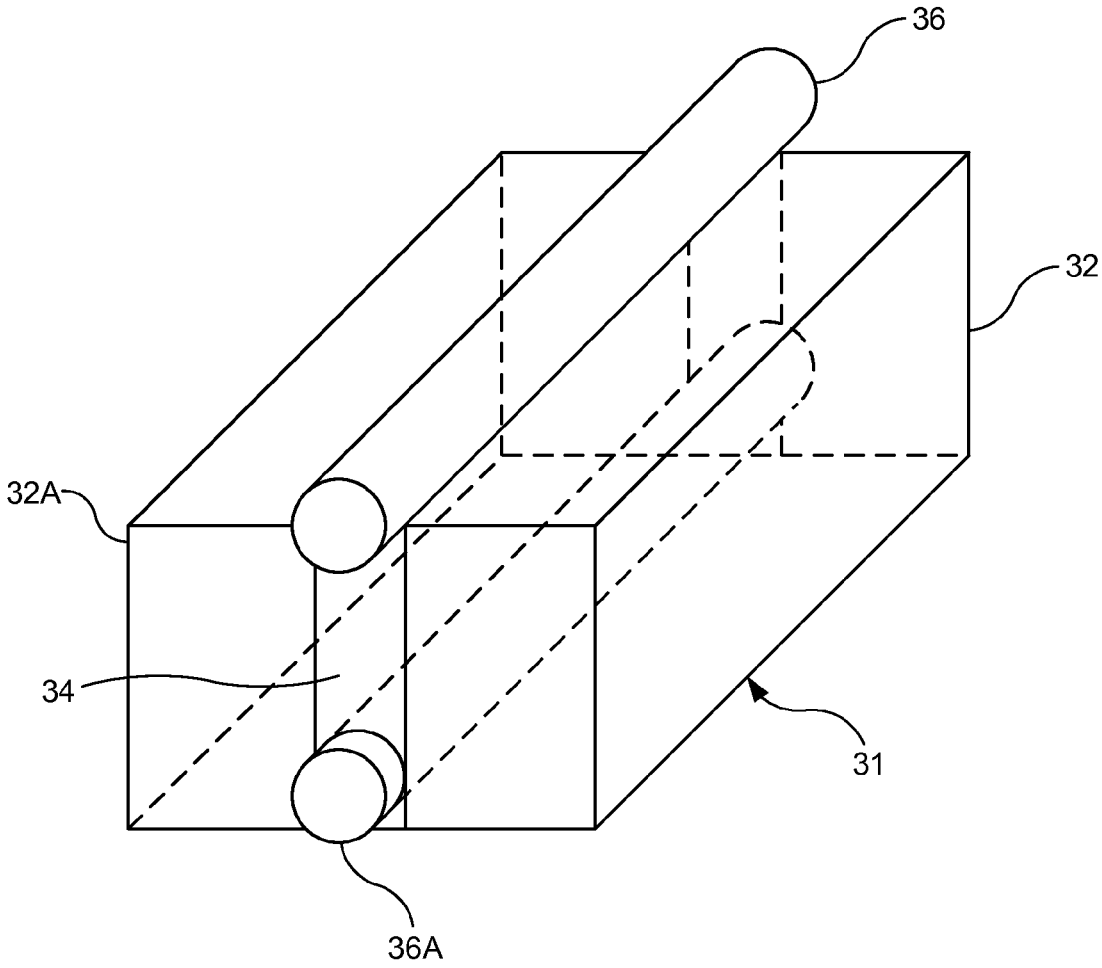
FIG. 3 is an isometric view of a third embodiment of the present invention wherein two uninsulated wires 36, 36A that have a transverse current flow create a high resistance area 34.

FIG. 3 shows a device having trip means comprising two elements 36 and 36A that carry electrical current and provide same to the conductive matrix 31 in a transverse direction to the main current flowing from terminal 32A to terminal 32 (or vice versa). This transverse current produces the hotline 34 which causes the increased voltage drop at this volume 34, as described above. It is again noted that the geometric removal of part of the conductive material of the matrix 31 narrows the primary current path, thus promoting the formation of the hotline in this section 34. It also should be noted that the hotline 34 may occupy all of the volume of the conductive matrix 31 if and when the volume of region 34 increases to the point where it touches the outer faces of conductive terminals 32 and 32A.

The above description is included to illustrate the operation of preferred embodiments, and is not meant to limit the scope of the invention. The scope of the invention is to be limited only by the following claims. From the above discussion, many variations will be apparent to one skilled in the art that would yet be encompassed by the spirit and scope of the prevent invention. For example, while the drawings show the trip components 3, 24, 36, 36A as conductors having circular cross-sections, these cross-sections may be rectangular, elliptical, trapezoidal or another geometric shape.

The invention claimed is:

1. Apparatus comprising:

electrically conductive material having specific resistance properties as a function of temperature, said material adapted to control delivery of electrical power to a load, wherein the conductive material has a geometrical design chosen to facilitate a non-linear resistance change within the material; and means for modulating the power delivered to the load, said modulating means comprising at least one of:

a modulator intrinsic to the material;

intrinsic PTC or NTC behavior of the material itself.

2. The apparatus of claim 1 further comprising means for externally controlling the modulator.

3. The apparatus of claim 1 wherein the conductive material is a conductive polymer having variable resistance as a function of temperature.

4. The apparatus of claim 1 further comprising a thermal path within the conductive material, said thermal path modifying the switch characteristics of the apparatus.

5. The apparatus of claim 4 further comprising a thermal insulation overcoating the conductive material, said insulation adapted to change the time constant of the thermal path during reset of the apparatus.

6. The apparatus of claim wherein the conductive material is a polymer having a variable non-uniform resistance, said resistance providing the apparatus with specific properties enabling shutting off the flow of electrical power through the apparatus.

7. The apparatus of claim 1 further comprising cutoff means for adding an electrical current through the material to force a sudden cutoff of power to the load.

8. Apparatus comprising:

electrically conductive material having specific resistance properties as a function of temperature, said material adapted to control delivery of electrical power to a load; and means for modulating the power delivered to the load, said modulating means comprising at least one of:

a modulator intrinsic to the material;

intrinsic PTC or NTC behavior of the material itself;

said apparatus further comprising cutoff means for adding an electrical current through the material to force a sudden cutoff of power to the load;

wherein the cutoff means comprises a rod or tube adapted to instigate a resistance change within the material to modify the power cutoff characteristics.

9. The apparatus of claim 8 wherein the rod or tube contains a fluid.

10. Apparatus comprising:

electrically conductive material having specific resistance properties as a function of temperature, said material adapted to control delivery of electrical power to a load; and means for modulating the power delivered to the load, said modulating means comprising at least one of:

a modulator intrinsic to the material;

intrinsic PTC or NTC behavior of the material itself;

said apparatus further comprising cutoff means for adding an electrical current through the material to force a sudden cutoff of power to the load;

wherein the cutoff means comprises a fiber optic tube adapted to heat the conductive material.

11. Apparatus comprising:

electrically conductive material having specific resistance properties as a function of temperature, said material adapted to control delivery of electrical power to a load; and means for modulating the power delivered to the load, said modulating means comprising at least one of;

a modulator intrinsic to the material;

intrinsic PTC or NTC behavior of the material itself;

said apparatus further comprising cutoff means for adding an electrical current through the material to force a sudden cutoff of power to the load;

wherein the cutoff means comprises a void tube into which a laser beam is introduced for purposes of heating the conductive material.

12. The apparatus of claim 1 wherein the conductive material is a ceramic PTC substance such as barium titinate.

13. Apparatus comprising an electrically conductive material having specific resistance properties as a function of temperature, said apparatus controlling delivery of electrical power to a load, said apparatus further comprising a control means intrinsic to the material for controlling said delivery of power, said control means having a different loading than the remainder of the conductive material, thereby constituting a hotline at a preselected location within the material; wherein:

an external magnetic or pressure force stimulus is applied to the control means to promote the formation of the hotline.

14. The apparatus of claim 13 wherein part of the conductive material is removed to promote the formation of the hotline.

15. Apparatus comprising an electrically conductive material having resistance properties of a normally loaded structure for control of delivery of electrical power to a load, said delivery controlled by a part intrinsic to the conductive material, said part having a different loading than the remainder of the conductive material to produce a hotline at a preselected location within the material; wherein:

an external magnetic or pressure force stimulus is applied part having a different loading to promote the formation of the hotline.

16. The apparatus of claim 15 wherein a portion of the conductive material is removed to promote the formation of the hotline.

17. Apparatus comprising an electrically conductive material having resistance properties of a normally loaded structure for control of delivery of electrical power to a load, said delivery controlled by narrowing a primary conductive path within the material to produce an area of different loading and thereby promote the formation of a hotline within the material.

18. The apparatus of claim 17 wherein a portion of the conductive path within the material is removed to promote the formation of the hotline.

19. The apparatus of claim 17 where an external thermal, magnetic, or pressure force stimulus is applied to the area of different loading to promote the formation of the hotline.

20. The apparatus of claim 8 wherein the rod or tube is electrically conductive and is electrically insulated from the electrically conductive material.

21. The apparatus of claim 8 wherein the rod or tube is an electrically conductive wire and is electrically insulated from the electrically conductive material.

22. The apparatus of claim 8 wherein the rod or tube is heated.

* * * * *

UNITED STATES PATENT AND TRADEMARK OFFICE

CERTIFICATE OF CORRECTION

PATENT NO. : 8,410,892 B2
APPLICATION NO. : 13/211907
DATED : April 2, 2013
INVENTOR(S) : Chester L. Sandberg It is certified that error appears in the above-identified patent and that said Letters Patent is hereby corrected as shown below:

On the Title Page, Column 2, Item (74)

"Radio IP Law Group; Edward J. Radio" should be corrected to read --Radlo IP Law Group; Edward J. Radlo--

Signed and Sealed this
Twenty-eighth Day of May, 2013

Teresa Stanek Rea
*Acting Director of the United States Patent and Trademark Office*